US007398738B2

(12) United States Patent
Newhouse et al.

(10) Patent No.: US 7,398,738 B2
(45) Date of Patent: Jul. 15, 2008

(54) WORKSTATION WITH ADJUSTABLE HEIGHT WORK SURFACE

(75) Inventors: Thomas J. Newhouse, Grand Rapids, MI (US); Paul B. Jager, Hamilton, MI (US); Robert E. Seaberg, North Muskegon, MI (US)

(73) Assignee: Hekman Furniture Company, Grand Rapids, MI (US)

( * ) Notice: Subject to any disclaimer, the term of this patent is extended or adjusted under 35 U.S.C. 154(b) by 359 days.

(21) Appl. No.: 11/105,600

(22) Filed: Apr. 14, 2005

(65) Prior Publication Data

US 2006/0230992 A1 Oct. 19, 2006

(51) Int. Cl.
*A47B 9/00* (2006.01)

(52) U.S. Cl. ..... 108/147; 108/50.01

(58) Field of Classification Search ..... 108/50.01, 108/50.02, 147, 147.11; 248/188.5, 188.2, 248/188.1; 312/223.1, 223.2, 223.3
See application file for complete search history.

(56) References Cited

U.S. PATENT DOCUMENTS 4,651,652 A * 3/1987 Wyckoff ..... 108/147
4,790,611 A * 12/1988 Craner ..... 108/147
5,088,421 A 2/1992 Beckstead
5,129,611 A * 7/1992 Grover et al. ..... 108/147
5,322,025 A * 6/1994 Sherman et al. ..... 108/147
5,845,587 A * 12/1998 Ditonto ..... 108/50.01
5,845,590 A 12/1998 Seidl
5,884,882 A * 3/1999 Nada et al. ..... 248/188.2
5,974,983 A * 11/1999 Bogucki ..... 108/147
6,055,912 A 5/2000 Doud et al.
6,085,670 A * 7/2000 Genov ..... 108/147
6,241,329 B1 * 6/2001 Nielsen ..... 108/50.02
6,286,441 B1 * 9/2001 Burdi et al. ..... 108/147
6,343,556 B1 * 2/2002 Lanphear ..... 108/147
6,494,150 B1 * 12/2002 Phoenix et al. ..... 108/147
6,986,310 B2 * 1/2006 Calfas et al. ..... 108/147
7,128,003 B2 * 10/2006 Okninski ..... 108/147

OTHER PUBLICATIONS

Altus; ascend application guide: small tables and carts; 16 pp.

* cited by examiner

*Primary Examiner*—José V Chen
(74) *Attorney, Agent, or Firm*—Warner Norcross & Judd LLP

(57) ABSTRACT

A work station with an adjustable height work surface includes a telescoping height adjustment mechanism. Stabilizers, spaced apart from the telescoping height adjustment mechanism, prohibit rotation of the work surface. A pair of guide members is attached to support walls by way of slides. The slides allow movement of the work surface vertically prohibiting rotational movement of the work surface. The workstation is provided with sidewalls allowing the workstation to be used with other pieces in modular configuration.

12 Claims, 5 Drawing Sheets

WORKSTATION WITH ADJUSTABLE HEIGHT WORK SURFACE

BACKGROUND OF THE INVENTION

The present invention relates to workstations, and particularly to a workstation with a vertically moveable desktop, which may be moved up or down to create a more comfortable working environment.

Workstations provide a work surface for the user. At one time, workstations were used almost exclusively as a place to write. However, due to the prevalence of the computer, the workstation is used for many different tasks. For example, a user may wish to write, draw, type on a computer, or use a printer. The workstation at the office is usually ergonomically optimized for one person of a particular height.

At home, one workstation may need to perform several different functions. It may be a computer area at one time and then may be used to write checks a few minutes later. A home workstation is often used by several different people. Optimally, the work surface of the workstation would be quickly adjustable to several different heights to accommodate different users and different tasks.

However, most sit-to-stand workstations are often difficult to adjust or mechanically complicated. For example, the height adjustable table shown in U.S. Pat. No. 6,055,912 issued to Galen C. Doud et al. and assigned to HON Technology, Inc., requires a user to adjust a bracket located on each leg of the workstation in order to change the height of the work surface. On the other hand, the workstation shown in U.S. Pat. No. 5,845,590 and issued to Lon D. Seidel and assigned to Krueger International, Inc. uses a complex arrangement of chains and screws to raise and lower the work surface.

An improved height adjustable workstation which is easily adjustable and uses a simpler mechanism to raise and lower the work surface is thus highly desirable.

SUMMARY OF THE INVENTION

A sit-to-stand article of furniture includes a work surface and a telescoping height adjustment mechanism. The telescoping height adjustment mechanism preferably includes an elastomeric element. The telescoping height adjustment mechanism is attached to the base of the work surface and extends through a first shelf located below the work surface. The telescoping height adjustment mechanism is then attached to a second shelf.

The work surface is attached to a first guide member and a second guide member. The first guide member and second guide member extend generally downward from the work surface, and pass through a pair of slots located within the first shelf. The guide members are only partially enclosed by the slots, allowing a first panel to be attached to the outer portion of the guide members.

A pair of interior support walls extends from the second shelf to the base of the first shelf. A slide connects each guide member to a respective support wall. These act as stabilizers to prevent rotation of the work surface.

A second panel is affixed to the outer portion of the interior support walls. The telescoping height adjustment mechanism is thereby enclosed behind the first panel and the second panel.

The first shelf, the second shelf and the work surface are provided with a plurality of cut outs so as to provide raceways for cabling extending throughout the workstation. The work surface is also provided with a back. A track located within the back allows a variety of accessories to be attached to the work surface.

Sidewalls and a modesty panel enclose the first shelf and the second shelf, with the work surface being capable of extension above and below the tops of the sidewalls. An upper module, such as a hutch, can be placed on the sidewalls to provide additional overhead storage space as well as a decorative affect.

The workstation as so configured provides an adjustable height work surface. Due to the use of stabilizers, a relatively inexpensive height adjustment mechanism can be used, thereby providing the benefit of a sit-to-stand work surface at an economical price.

These and other objects, advantages, and features of the invention will be readily understood and appreciated by reference to the detailed description of the preferred embodiment and the drawings.

BRIEF DESCRIPTION OF THE DRAWINGS

Similar reference characters denote corresponding features consistently throughout the attached drawings.

DETAILED DESCRIPTION OF THE DRAWINGS

Figure 1:
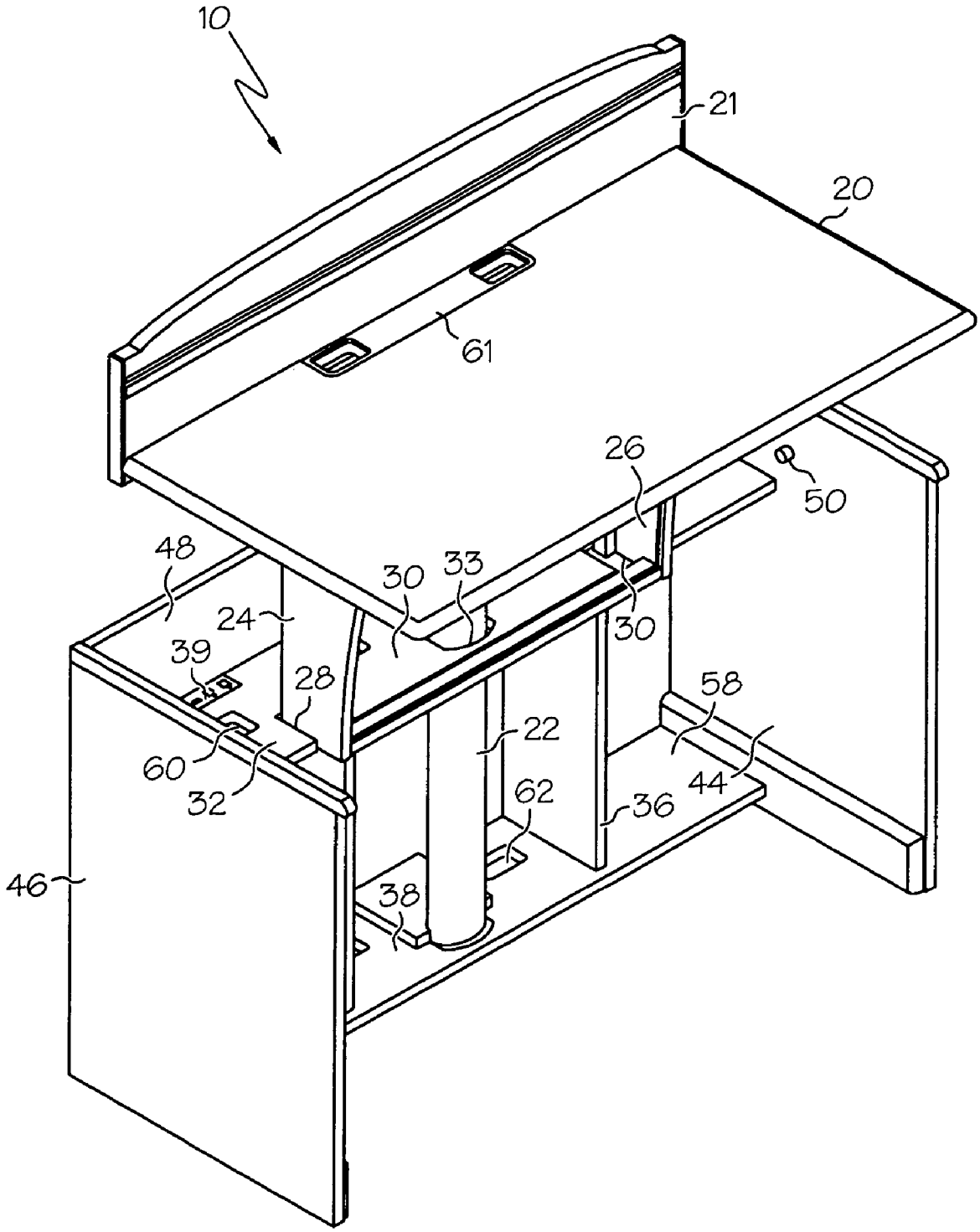
FIG. 1 is a perspective view of a workstation according to the present invention with the work surface raised.
Figure 2:
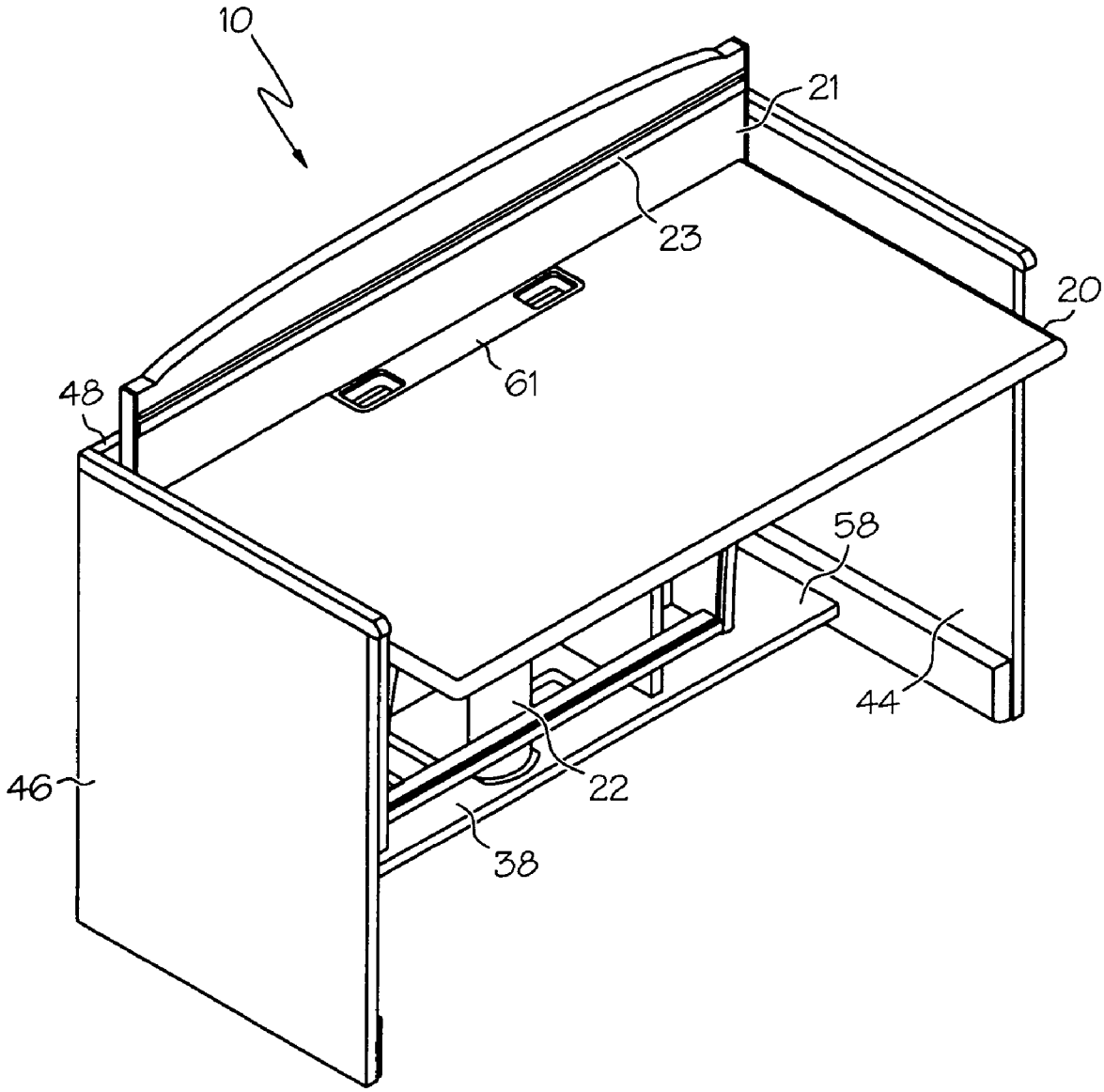
FIG. 2 is a perspective view of a workstation according to the present invention with the work surface lowered.

The present invention is a workstation, designated generally as 10 in FIGS. 1, 2 3, 4 and 5. The workstation 10 features a generally horizontal work surface 20 that raises and lowers when the user activates telescoping height adjusting mechanism 22 by pinching the finger paddle 41.

Back 21 is attached to work surface 20. Rail 23 extends across back 21, allowing various accessories to be easily attached to back 21.

Height adjusting mechanism 22 could be any of several different types of height adjusting mechanism including pneumatic, screw, or spring. Height adjusting mechanism 22 could have an elastomeric element. A preferable height adjusting mechanism is manufactured by Altus, Inc. of Grandville, Mich. and known generally as the "Ascend" height adjustment mechanism.

Work surface 20 is attached to guide members 24, 26. Guide members 24, 26 extend through guide slots 28, 30 in middle shelf 32. Interior supports 34, 36 extend from the bottom of middle shelf 32 to the top of lower shelf 38. Guide members 24, 26 fit within guide slots 28, 30. Guide members 24, 26 extend longitudinally out of guide slots 28, 30. Height adjustment mechanism 22 extends through middle shelf 32 by way of hole 33.

Slides 40, 42 are attached to guide members 24, 26 and interior supports 34, 36. Slides 40, 42 are preferably rail type slide assemblies. Ball bearing slides could be used to provide smooth and free movement. More economical alternatives are also available in the form of wood or plastic groove type slide assemblies, which are sometimes used as drawer guides. Finger paddle 41 is an actuator which controls the operation of height adjusting mechanism 22.

In operation, a user presses finger paddle 41, allowing the operation of height adjusting mechanism 22. Guide members 24, 26, slides 40, 42 and supports 34, 36 act as stabilizers to prevent rotation of work surface 20. While two stabilizers are shown, a single stabilizer could be sufficient in some applications. The stabilizers are spaced from height adjustment mechanism 22 by a distance of about fourteen inches. By using a stabilizer to reduce rotation of work surface 20, height adjustment mechanism 22 provides the load bearing for work surface 20.

Sidewalls 44, 46 along with modesty panel 48 provide an aesthetic enclosure for workstation 10. Middle shelf 32 and lower shelf 38 are attached to sidewalls 44, 46 and modesty panel 48.

Workstation 10 could be provided with stops 50, 52 to prohibit movement of work surface 20 below a predetermined level. Stops 50, 52 located on the interior of sidewalls 44, 46 can be adjustable so that the lowest level of work surface 20 can be changed as needed. Stops 50, 52 could thus be configured to retain work surface 20 at the same level as the top of sidewalls 44, 46. Stops 50, 52 could be pins inserted within sidewalls 44, 46.

Figure 3:
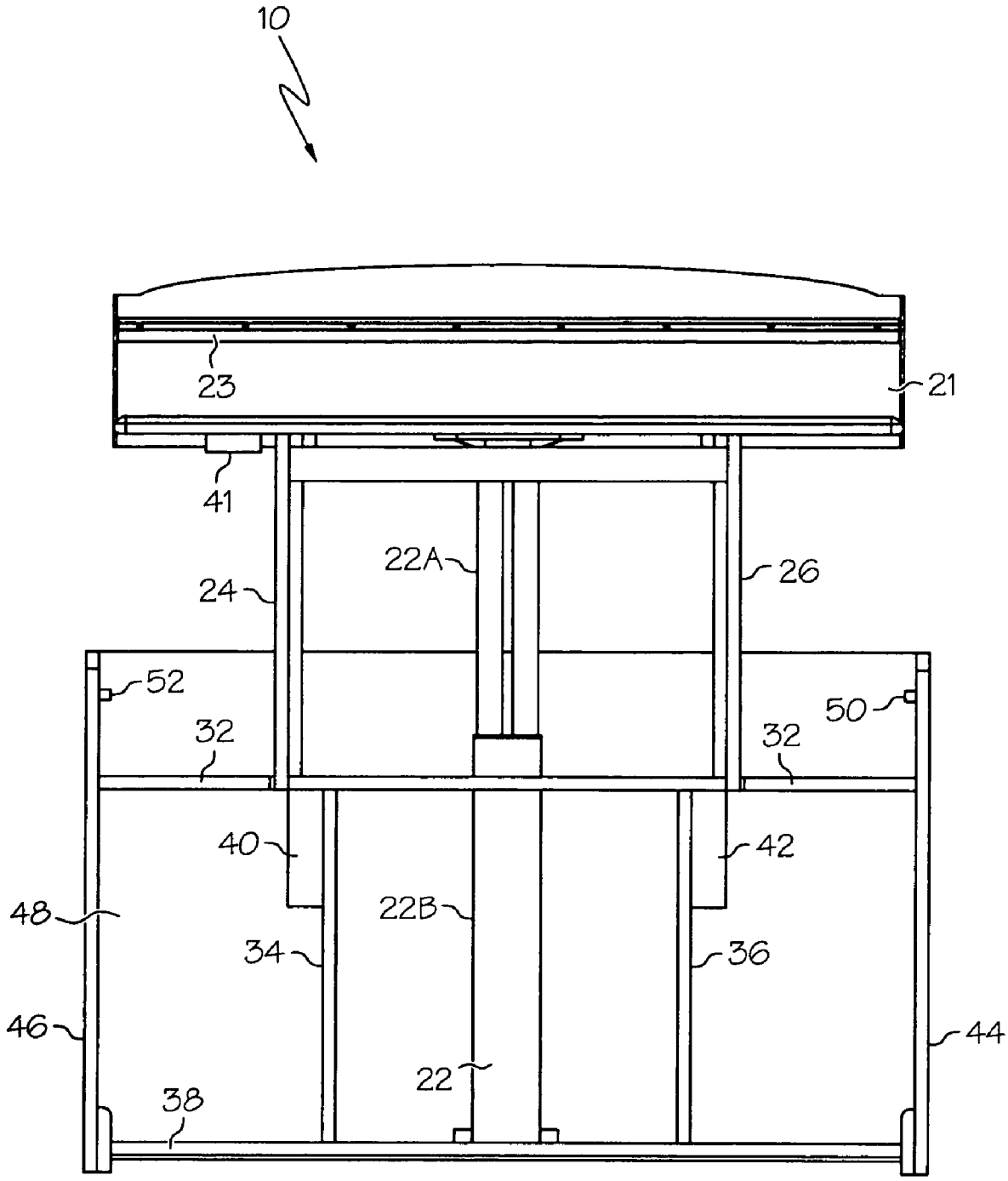
FIG. 3 is a front view of a workstation according to the present invention with the work surface raised.

Referring specifically to FIG. 3, preferably the junction of the top portion 22A and the lower portion 22B of height adjustment mechanism 22 occurs above middle shelf 32.

Returning to FIG. 2, middle shelf 32 and lower shelf 38 provide easily accessible storage areas for a user. Storage area 58 has sufficient depth for the placement of a personal computer tower. Cut outs 60 in middle shelf 32, cut out 61 in work surface 20, and cut outs 62 in lower shelf 38 provide a cable raceway for power cords, network cables and the like.

A computer or other electronic device placed on work surface 20 can be connected by way of outlet center 39 includes to power outlet, a USB port, an RJ-45 outlet, and a telephone jack.

Figure 4:
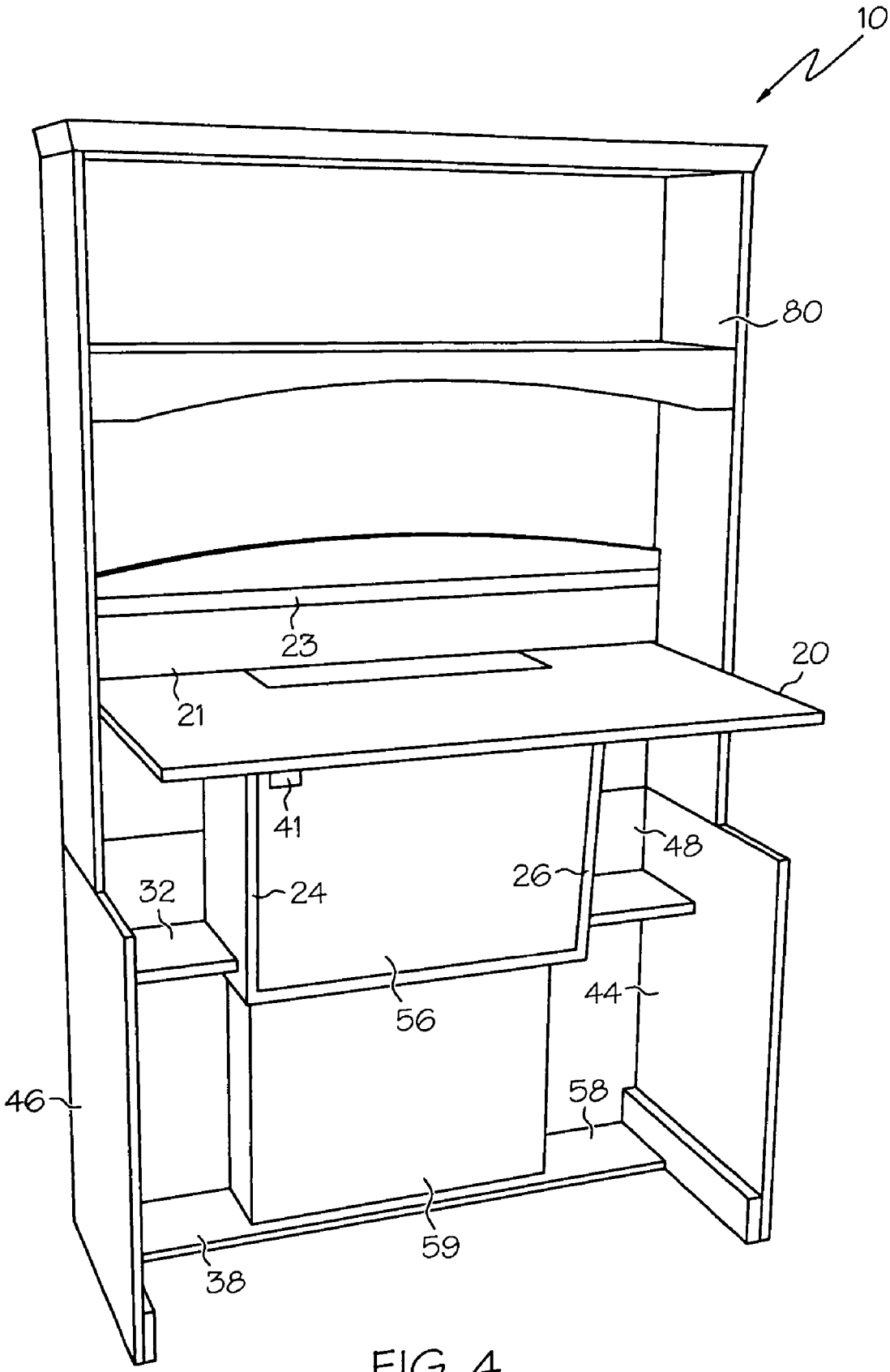
FIG. 4 is a perspective view of a workstation according to the present invention with an upper module positioned over the workstation.

FIG. 4 shows the article of furniture in a more finished configuration. Upper panel 56 is affixed to guide members 24, 26 to enclose the top portion of height adjustment mechanism 22. Thus, the junction of top portion 22A and lower portion 22B is hidden from a user by upper panel 56. Lower portion 22B is shown enclosed by lower panel 59. Lower panel 59 is attached to interior support walls 34, 36. Since guide members 24, 26 extend outside of slots 28, 30, lower panel 59 is partially concealed by upper panel 56. Thus, height adjustment mechanism 22 is completely hidden from a user. Alternatively, lower portion 22B could be provided with a decorative outer casing.

Upper module 80 is positioned on top of workstation 10. Upper module 80 could be a hutch or any similar type furniture unit. The base of upper module 80 sits upon the top of sidewalls 44, 46 and modesty panel 48.

Work surface 20 is of such length as to fit completely within the space between sidewalls 44, 46. Further, work surface 20 can be lowered to the same height or below the tops of sidewalls 44, 46 and modesty panel 48.

Figure 5:
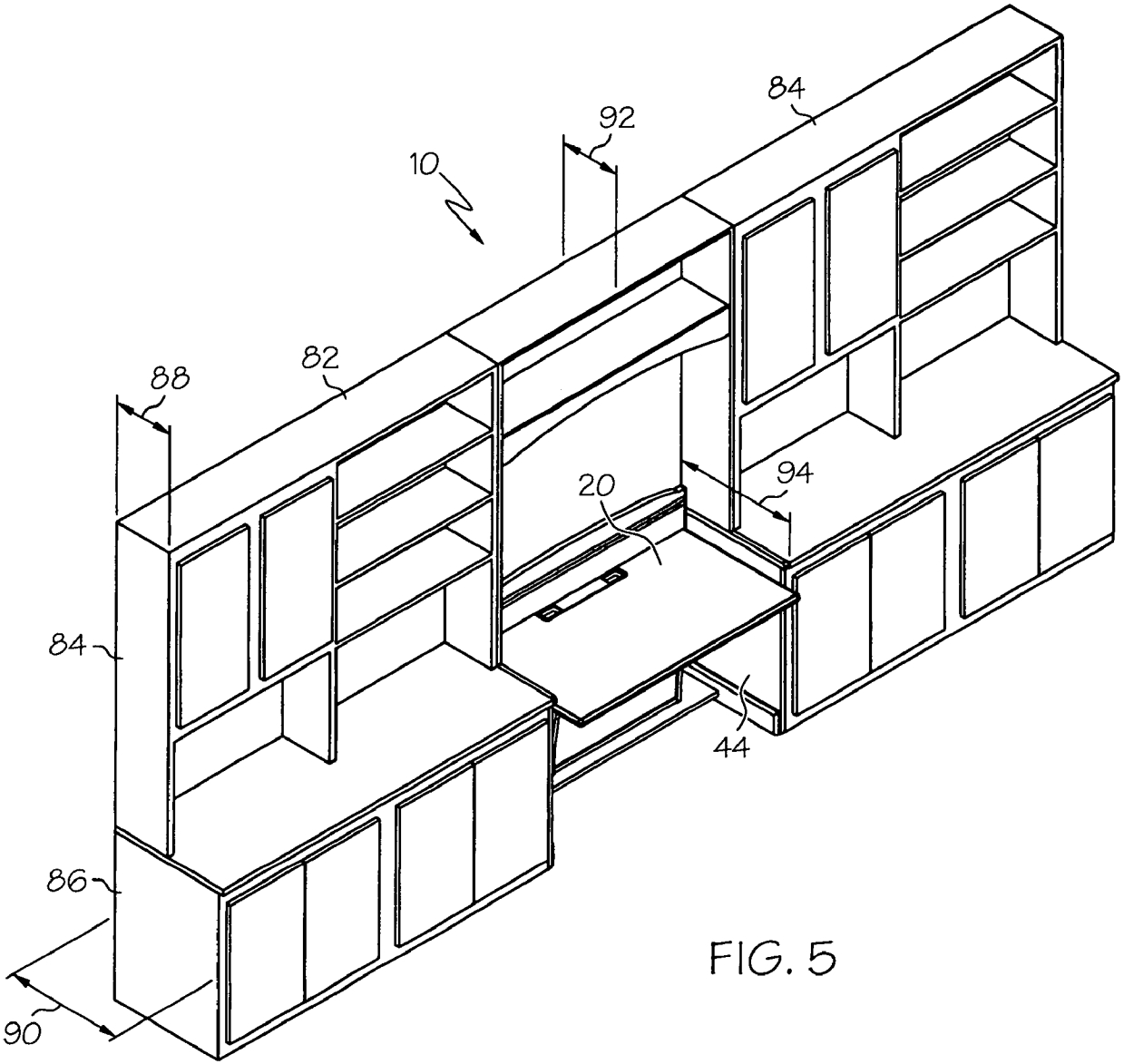
FIG. 5 is a perspective view of a workstation in the middle of two furniture units.

FIG. 5 shows workstation 10 within a system of furniture units. Sidewalls 44, 46 allow other furniture units to be placed immediately adjacent to workstation 10 while modesty panel 48 allows the workstation to be placed adjacent to a wall. Sidewalls 44, 46 and modesty panel 48 prevent the movement of work surface 20 from being obstructed by items adjacent to work station 10. Additionally, the distance between the edges of work surface 20 and sidewalls 44, 46 can be relatively close, providing an aesthetically appealing appearance. A gap between work surface 20 and sidewalls 44, 46 of approximately ¾ inch is desirable to avoid finger pinch.

Due to the enclosure of work surface 20 within sidewalls 44, 46, furniture units 82, 84 can be placed immediately adjacent to workstation 10. The thickness of sidewalls 44, 46 can therefore be made the same as the sidewalls of furniture units 82, 84 while the height and depth of the upper unit can also be made to complement that of furniture units 82, 84.

The depth 94 of workstation 10 matches the depth 90 of the lower portion 86 of furniture units 82, 84, while the depth 92 of upper module 80 is the same as the depth 88 of the upper portion of furniture units 82, 84. By matching the depth of workstation 10 with the furniture units, a contiguous, dimensionally matched and aesthetically pleasing modular configuration can be easily created.

The result is a work station with the ergonomically desirable feature of a height adjustable work surface with the ability to be aesthetically integrated with other furniture. This allows workstation 10 to be used in a variety of environments, such as a home office, kitchen or dining room.

Workstation 10 could also be constructed as a corner unit. If constructed as a corner unit, sidewalls 44, 46 would be spaced apart and perpendicular to each other. Interior support walls 34, 36 could either be parallel or perpendicular. Workstation 10 may be constructed from different materials such as, wood, metal, plastic, glass or any combination thereof.

The above description is of the preferred embodiment. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The embodiments of the invention in which an exclusive property or privilege is claimed are defined as follows:

1. An article of furniture comprising:

a work surface;

a telescoping height adjustment mechanism having a second end attached to the work surface and a first end;

a first support wall;

a first shelf attached to the first support wall and located intermediate the telescoping height adjustment mechanism, the first shelf defining a hole and a slot, the telescoping height adjustment mechanism extending through the hole in the first shelf;

a second shelf attached to the first support wall and located at and attached to the first end of the telescoping height adjustment mechanism;

a first stabilizer to prevent rotation of the work surface, the first stabilizer spaced from the telescoping height adjustment mechanism, the first stabilizer including a first guide member extending through the slot in the first shelf;

a second stabilizer spaced from the telescoping height adjustment mechanism and the first stabilizer; and the first stabilizer, the second stabilizer, and the telescoping height adjustment mechanism being generally parallel.

2. The article of furniture of claim 1 further comprising a second slide attached to the first support wall and the first guide member.

3. The article of furniture of claim 2 where the second stabilizer includes a second guide member.

4. The article of furniture of claim 3 where the second guide member extends through a second slot in the first shelf.

5. The article of furniture of claim 4 further comprising a second support wall, the second support wall attached to first shelf and the second shelf.

6. The article of furniture of claim 5 where the first slide and the second slide are rail slide assemblies.

7. The article of furniture of claim 6 where the slides are ball bearing slide assemblies.

8. The article of furniture of claim 7 further comprising a first sidewall and a second sidewall.

9. The article of furniture of claim 8 further comprising an upper unit positioned on the first sidewall and the second sidewall.

10. The article of furniture of claim 9 where the first guide member is partially enclosed within the first slot and the second guide member is partially enclosed within the second slot.

11. The article of furniture of claim 10 where a first panel is affixed to the first guide member and the second guide member.

12. The article of furniture of claim 11 where a second panel is affixed to the first support wall and the second support wall.

* * * * *